United States Patent [19]

Kurz

[11] 4,233,597

[45] Nov. 11, 1980

[54] DEVICE INDICATING A STATE DUE TO THE PRESSURE MODIFICATION

[76] Inventor: Gerhard Kurz, Industriestrasse, 7261 Althengstett, Fed. Rep. of Germany

[21] Appl. No.: 888,426

[22] Filed: Mar. 20, 1978

[30] Foreign Application Priority Data

Mar. 19, 1977 [DE] Fed. Rep. of Germany ..... 2712201

[51] Int. Cl.[2] ..... G08B 21/00

[52] U.S. Cl. ..... 340/626; 55/274; 55/DIG. 34; 200/83 R; 340/607

[58] Field of Search ..... 340/607, 632, 654, 381, 340/626; 200/83 R; 116/114 AB; 55/274, DIG. 34

[56] References Cited

U.S. PATENT DOCUMENTS

| | | | |
|---|---|---|---|
| 2,114,105 | 4/1938 | Gerber | 116/114 AD X |
| 2,230,113 | 1/1941 | Hein | 55/DIG. 34 |
| 2,468,768 | 5/1949 | Malick | 340/632 X |
| 2,803,816 | 8/1957 | Alden | 340/654 |
| 2,900,468 | 8/1959 | Joy | 200/83 R X |
| 2,927,659 | 3/1960 | Pabst et al. | 55/274 X |
| 3,018,343 | 1/1962 | Grostick | 340/617 X |
| 3,505,791 | 4/1970 | Breslin | 55/274 |
| 3,516,087 | 6/1970 | Rueger | 340/381 |

*Primary Examiner*—John W. Caldwell, Sr.
*Assistant Examiner*—Daniel Myer
*Attorney, Agent, or Firm*—Gifford, VanOphem, Sheridan & Sprinkle

[57] ABSTRACT

The invention concerns a device indicating a state due to the pressure modification, in particular an overpressure or a vacuum pressure switch for the indication of the fullness of the dust bags in household or industrial vacuum cleaners with a diaphragm exposed on one side to the variable pressure and with a contacting action between two contact elements as caused by the diaphragm's movement.

6 Claims, 3 Drawing Figures

DEVICE INDICATING A STATE DUE TO THE PRESSURE MODIFICATION

BACKGROUND OF THE INVENTION

It is known how to make observable the pressure variations which take place, by means of a spring tensioned diaphragm; such indicating devices are applied and used in a number of manners in several technical domains.

One possibile application of such devices is to indicate the degree of fullness of the household or industrial vacuum cleaners. The invention concerns particularly such an indicating device, but it could, of course, be used in other comparable applications, for example, whenever a pressure modification attaining a certain threshold value has to be indicated externally, or when pressure modifications are used for controlling or regulating purposes and for the introduction of other working functions.

The indication of the fullness of dust bags or vacuum cleaners in general which do not include a bag-like dust catching system, is known to use the vacuum pressure which increases as the vacuum cleaner fills with dust, by means of an indicating element which is located in a pressure tight conduit and is pushed against the holding force of a spring from its initial position under the influence of the acting pressure. Such displacement of the prefereably colored indicating element can be observed by the appliance's operator through an inspection window so that he can proceed to empty the vacuum cleaner when the indicating element has attained a certain position corresponding to a certain maximum (allowable) load, beyond which the vacuum cleaner operates only uneconomically.

It is also known how to replace such a mechanical indication by an electrical contact circuit. In this case a diaphragm is also used, and is located and carried in an appropriate manner. This diaphragm closes a space which communicates with the vacuum pressure, or in general with the pressure variations generating system. The diaphragm is essentially flexible but is however held taut by an appropriate spring in such a way, that at a given displacement of the diaphragm corresponding to pressure variations, a contact element carried by the diaphragm comes in contact with a second, stationarily positioned contact element. In this manner an electric circuit is closed, which produces an indication or a different switching action. The drawback of this known system consists in the fact that an adjustment of the device to a desirable predetermined threshold pressure value is relatively complicated, since one has to modify the tension produced by the spring on the pretensioned diaphragm in such a way that the contact takes place precisely at the predetermined threshold pressure value. It can be done by the modification of the application point of the spring, which, however, demands that the system, after the finished final assembly of other components, has to be dismantled again; a certain vacuum pressure value has then to be produced and the adjustment has to be made to correspond to that value.

Such an adjustment is necessary, since the pressure data of the substantially identical appliances differ from each other within certain value limits.

SUMMARY OF THE PRESENT INVENTION

In such indicating devices it is particularly desirable to make the moment of the obtaining of the predetermined threshold pressure value observable by means of a visible luminous indicator.

The invention provides a simple indicating device which provides a certain adjustable threshold pressure value, a device which is compact and inexpensive, and which permits the indication of the attaining of the threshold pressure value with an accuracy sufficient for the aims pursued. Of a particular importance is the advantage of a simple adjustment procedure, especially after incorporation of the indicating device into the machine and complete assembly of all component parts and devices.

The invention obviates the above-mentioned disadvantages by providing a device for the indication of a state due to the pressure variation, and in particular, from the excess pressure or the vacuum pressure switches for the indication of the fullness of the dust bags in household and industrial vacuum cleaners, or similarly, with a diaphragm exposed to the pressure influence, whose movement displaces a pressure rod, placed and guided in a housing, fastened to the diaphragm and loaded by a spring, in such a way, that there results an electrical contact between two elements forming a switch.

That device, in the spirit of the invention, is formed so that the housing is closed by a diaphragm fastened to it frontally, that on the housing side opposite to the diaphragm there is arranged a lamp space for immediate indication, and that from this space are accessible corresponding parts of the switch, permitting thus the adjustments of the threshold pressure response value.

In such an indicating device, it is particularly advantageous that there are used comparatively few construction elements and that the whole indicating device is provided in a compact and assembly-ready manner so that it can be easily installed in an existing opening in the assembled appliance.

In an advantageous example of the present invention, the pressure rod attached to the diaphragm is shaped as a contact pin, and the corresponding counter-contact element which it touches, is shaped, movably supported and is disposed in such a manner, that after insertion of the housing with the indicating device into the assembled appliance, it remains accessible from outside. It is therefore not necessary to reach and adjust the diaphragm tensioning spring as in previously known devices. In addition, the device is reached and adjusted under actual operating conditions so that the position of the contact element can be adjusted to correspond precisely to the desired threshold pressure.

Alternatively, both the contact and the switch elements can be constructed as microswitches.

Further elements of the constructed invention are provided for subsididary requirements and will be discussed with the same.

BRIEF DESCRIPTION OF THE DRAWINGS

In the following text, the construction and working manner of the preferred examples of the invention will be explained in more detail as based on the accompanying figures.

These figures show.

Figure 1:
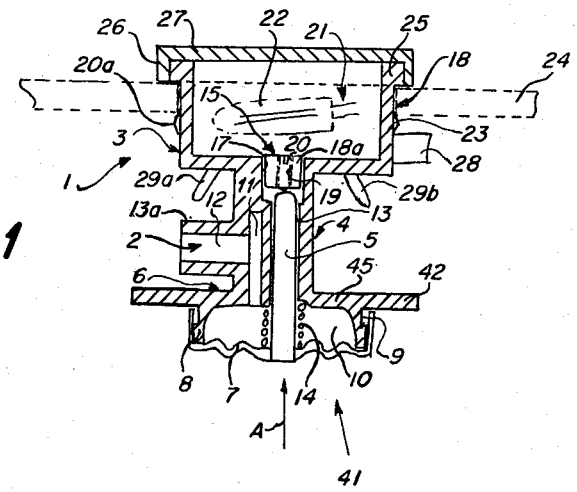
FIG. 1—A sectional view of an example of a complete indicating device for the pressure variation.

Shown in FIG. 1 and designated by 1 is an indicating device including a preferably one-piece housing 2, containing all necessary construction elements and all switch contacts for transmitting signals and/or switching action when the pressure threshold value is attained. The housing includes an upper lamp space 3, a middle portion 4 where the contact pin 5 is guided, and a lower diaphragm portion 6. It will be understood that the shown housing form has to be considered as a single example and that it could be executed in any shape which is possible with existing forming and casting techniques.

It is essential that the principal elements, the lamp space 3, the guide portion 4 for the pressure pin or the contact pin, as well as a supporting device for the switches formed by the contact elements, and the diaphragm portion 6, are provided.

The diaphragm space on its side turned towards the housing is shaped in such a manner that the diaphragm 7 can be tightly fastened to an appropriate circular flange surface 8. The circular flange 8 can have a constriction 9 which prevents the diaphragm 7 from sliding. To that effect, over the diaphragm parts which abut against the circular flange 8 there may be spanned a ring clip or another fastening element. The diaphragm forms, together with the circular flange 8, a space 10 which through the appropriate connecting channels 11 and 12 communicates with the connecting nipple 13*a*. The nipple 13*a* is connected to the vacuum pressure source, for example, through a flexible tube pushed over the nipple 13*a*.

To the diaphragm 7, in this first example, there is connected the already mentioned contact pin 5 which can glide inside of a guiding channel 13 made as an inner bore through the housing 2. By means of an appropriate coil spring 14, the diaphragm is pretensioned so that, for example, when the diaphragm is exposed to no pressure, the contact pin 5 remains a predetermined distance away from the contact element shown at 15. The contact element can be made of any metallic member, which is preferably supported coaxially with the contact pin 5 in the guiding space in such a manner that under determined pressure conditions a contact takes place between the contact pin and the contact element, thus completing an electrical signal circuit.

In the chosen example, the contact element comprises a metallic bearing body 18*a*, inserted in a widened part of a bore hole 17 and fastened there, for example, by pressing or by gluing. It features an internal threading which receives an appropriate screw 20. The screw 20 can be made as a headless screw and can be threadably positioned inside of the threaded bore to maintain a predetermined distance with respect to the contact pin 5 when no pressure is applied to the device. It serves as the actual contact element, and enables a fine adjustment to be made from above, i.e., from the lamp space when the housing 1 is already incorporated in the assembled appliance.

Such an adjustment can, as already mentioned, take place preferably when the whole indicating device in this housing is already assembled and the housing itself is inserted in the opening 18 in the appliance.

The indicating device can be prevented from falling out of the opening 18 by arranging on the periphery at several places some wedge-shaped projections 20*a* disposed so that the housing can be clipped or wedged into the closely fitting opening. To that effect, the lamp space 3 adjacent to the guiding portion 4, is a circular bore 21 substantially larger than hole 17 for the location of an indicating lamp 22. The upper ring-shaped walls of the housing containing the lamp space 3 feature a flange 25 which is wider than the bore hole 18 of the assembled appliance 24. This flange is covered by the edge portion of a downwardly drawn preferably colored cover 27. The cover can be taken away from the flange 25 so that the lamp space 21 becomes freely accessible, and, if necessary, after removing or pushing aside the lamp 22, the screw 20 becomes freely accessible for precisely adjusting the contact element.

Figure 2:
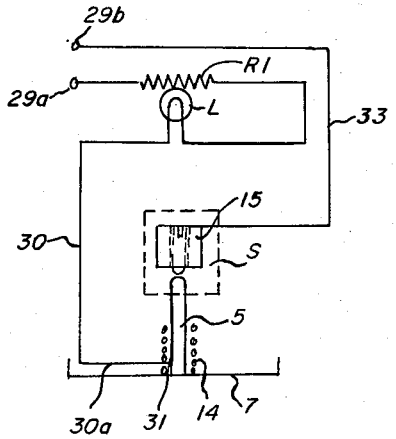
FIG. 2—A possible example of a circuit diagram, as used in the indicating device shown on FIG. 1, and FIG. 3—An alternative example with a micro-switch.

Through the plug connection 28, or contact strips 29*a* and 29*b*, to which electrical leads can be soldered or secured, the electric power is transmitted. The representation of the FIG. 2 illustrates a possible circuitry layout. The connecting terminals 29*a* and 29*b* receive an operating voltage, for example, the 220 volts; through an introductory resistance R1, voltage is supplied to the indicating lamp, which is shaped as a gas discharge lamp, and from this lamp, through an intermediary connection lead 30 to a contact connection point 31 on the contact pin 5. It will be understood that the connection lead 30 has to be placed and connected from a connection pole in an appropriate manner; the conducting length part 30*a* which is fastened to the contact connecting point 31 on the contact pin 5 must be movable, since it must follow the response action of the diaphragm. The circuit is completed when the touching part of the contact pin 5 contacts the contact element 15 so that the contact pin 5 and the contact element 15 form the switch S. From the contact element 15 in the example of FIG. 1, i.e., from the bearing body 18*a* on the screw 20, there runs the backfeed lead 33 to the other connecting terminal 29*b*.

The working mode of the indicating device is such that under the influence of the appropriate vacuum pressure through the channels 11 and 12 on the diaphragm 7, the diaphragm 7 is moved in the direction of the arrow A against the force of the coil spring 14, so that the contact pin 5 in the drawing plane of the FIG. 1 is moved upwards, and, after a corresponding adjustment of the contact element 15 at the moment of attaining the pressure threshold value enters into contact with the contact element 15. Thereby the electric circuit closes and the lamp 22 burns as long as the state remains unimproved, or while the dust bag remains full, which has led to the formation of the pressure threshold value.

It will be understood that it is the diaphragm action which is affected by and must be adapted to be influenced by different variations or applications of the pressure influence; it is therefore possible that the nipple 13*a* forms a vent towards the atmosphere, and through the insertion of the housing 2 of the indicating device 1 in its bearing opening 18, simultaneously and through an appropriate ring-shaped wall 40 of the assembled appliance takes place a tight closing of a space 41 formed below the diaphragm, by the ring-shaped wall 40 closing against a widened flange surface 42 of the housing-diaphragm part 6.

In such a case, an alternative switching action can be provided. If space 41 is under influence of a vacuum pressure, the coil spring 14 should be shaped as a draw spring, and the switch S should be reconstructed in such a way, that contact between the pin and the contact element occurs when the pin is displaced downwards. This is possible by making a projection on the contact pin 5 which touches a contact element projection extending down past the upper tip of the contact pin as the contact pin is forced downwards.

It will be understood too, that the way by which the channels 11 and 12 are led towards the nipple connection 13*a* can be chosen arbitrarily, and that in particular, the nipple 13*a* can be also fastened immediately at the horizontal wall 45 of the diaphragm portion 6, which limits the space 10 upwards. Through an appropriate dimensioning of the vacuum pressure feeding channels 11 and 12, the effect of the penetrating "false air" along the conduit 13 around the contact pin 5 can be made neglibile.

Therefore, another advantage of this invention is that adjustment of the indicating device in the wholly assembled state permits immediate compensation or adjustment for these "false air" influences.

As a further possible application example, one can consider also the filling state indicators in coffee making machines for which the contracted collar part of the housing can be made longer.

Figure 3:
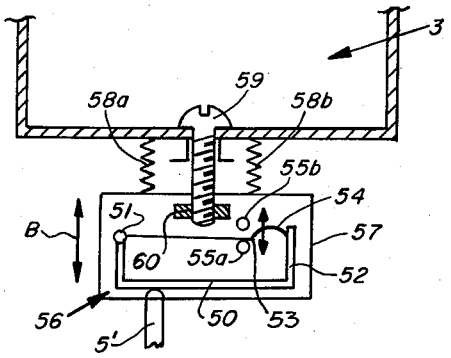

An alternative execution form is shown in the FIG. 3. In this device for the indication of the pressure variations, the switching part consists of a microswitch shown very schematically on the FIG. 3. The pressure pin 5' leans on a lever 50 which is pivotally supported at 51. Between a bent end 52 of the lever 50 and a pivotally supported contact tongue 53 there is placed a tensioning spring 54, which communicates with the contact tongue 53 in any contact position when the counter-contacts 55*a* and 55*b* are "beyond dead point" position.

An instantaneous switching is thereby obtained when the pressure threshold value is reached, which thereby avoids the slowly gliding nearing of the contacts which is sometimes accompanied by spark formation.

All moving switching parts of the microswitch 56 are assembled on a plate 57 or inside of a housing, which in turn is supported within the indicating device housing as vertically gliding. In that case, the microswitch 56 is as a whole, an analogous construction element to the contact element 15, while the pressure pin 5' has no electrical function any more. Through the vertical traveling of the whole of the microswitch housing 57 in the direction of the double arrow B, there results a nearing or a parting with respect to the position of the pressure pin 5' and therefore the adjustment of the response threshold value. The displacement can be adjusted by means of one or several tensioning springs 58*a*, 58*b* and a screw 59 which is connected with the housing 57 of the microswitch 56 by the threads 60.

The FIG. 3 shows separately only the essential parts which are different in this execution form.

I claim:

1. An apparatus for indicating pressure variations caused by the accumulation of dust in a vacuum cleaner, said apparatus comprising:

a housing having two hollow ends and an intermediate chamber portion having an outer periphery smaller than the outer periphery of at least one of said hollow ends therebetween;

a diaphragm directly secured over a first hollow end of said housing to form a first chamber;

a lamp disposed in a second hollow end of said housing;

switching means disposed within said intermediate chamber, said switching means comprising a contact element secured to said housing adjacent said second hollow end and a contact pin slidably mounted in the housing and having one end connected to the diaphragm and its other end adjacent the contact element;

means for resiliently urging said contact pin away from said contact element;

means for adjustably varying the position of the contact element with respect to the contact pin, said adjustable varying means being accessible from the second hollow end of the housing;

said housing being insertable into a receiving opening of the vacuum cleaner such that the lamp remains exposed exteriorly of the vacuum cleaner and the adjustable varying means is accessible from the exterior of the vacuum cleaner;

said chamber portion having an outwardly extending conduit including a port being connected to a pressure source in the vacuum cleaner which in conjunction with the pressure exteriorly of the diaphragm, is indicative of the pressure variations of the vacuum cleaner, and further having a fluid passageway adjacent said intermediate chamber connecting said conduit to said first chamber, and electrical circuit means for illuminating said lamp upon contact of said contact pin with the contact element.

2. The apparatus as defined in claim 1 wherein said intermediate chamber portion of the housing includes a guiding aperture, said contact pin being slidably received in said guiding aperture, and wherein said adjustable varying means comprises a threaded portion on the contact element.

3. The device as defined in claim 2 characterized in that said contact element includes a bearing body which is pressed into a widened part of said intermediate chamber portion above said guiding aperture and a contact screw which is threadably secured through the bearing body.

4. The device according to claim 1 wherein said housing is a one piece housing of a synthetic material.

5. The device as defined in claim 1 wherein said resilient means comprises a coil spring disposed in said first hollow end and abutting at one of its ends against the diaphragm and on the other end against the housing portion between said first chamber and said narrow chamber.

6. The device as defined in claim 1 wherein the outer periphery of said second hollow end includes a ring of rounded projections located so that the housing can be snapped into said receiving opening of the vacuum cleaner.

* * * * *